US010870193B2

(12) United States Patent
Kristiansen

(10) Patent No.: US 10,870,193 B2
(45) **Date of Patent: *Dec. 22, 2020**

(54) BEVERAGE CONTAINER OPENER

(71) Applicant: Robert M. Kristiansen, Shokan, NY (US)

(72) Inventor: Robert M. Kristiansen, Shokan, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/987,034

(22) Filed: Jun. 27, 2013

(65) Prior Publication Data

US 2014/0000042 A1 Jan. 2, 2014

Related U.S. Application Data

(63) Continuation of application No. 12/798,627, filed on Apr. 8, 2010, now Pat. No. 8,484,785.

(51) Int. Cl.

| | |
|---|---|
| ***B67B 7/00*** | (2006.01) |
| ***B25F 1/00*** | (2006.01) |
| ***B67B 7/16*** | (2006.01) |
| ***B67B 7/40*** | (2006.01) |
| ***B67B 7/44*** | (2006.01) |

(52) U.S. Cl.

CPC ..... *B25F 1/00* (2013.01); *B67B 7/16* (2013.01); *B67B 7/403* (2013.01); *B67B 7/44* (2013.01)

(58) Field of Classification Search

CPC .. B67B 7/16; B67B 7/403; B67B 7/14; B67B 7/44; B67B 7/406

USPC ..... 7/151, 152; 81/3.55, 3.57, 3.27

See application file for complete search history.

(56) References Cited

U.S. PATENT DOCUMENTS

| | | | | |
|---|---|---|---|---|
| 1,199,272 | A | 9/1916 | Hutter | |
| 1,728,418 | A | 9/1929 | Litchfield | |
| 4,018,110 | A * | 4/1977 | Spriggs | 81/3.08 |
| 4,583,429 | A | 4/1986 | Kroeger et al. | |
| 4,864,898 | A | 9/1989 | Tricinella | |
| 4,949,600 | A * | 8/1990 | Tricinella | 81/3.09 |
| 6,070,497 | A * | 6/2000 | Farelli | 81/3.09 |
| 7,614,321 | B2 * | 11/2009 | Cohen | B67B 7/403 7/151 |
| 8,484,785 | B1 * | 7/2013 | Kristiansen et al. | 7/151 |
| 8,695,457 | B2 * | 4/2014 | Rozmus et al. | 81/3.57 |
| 2006/0219058 | A1 * | 10/2006 | Farentinos et al. | 81/3.55 |

* cited by examiner

*Primary Examiner* — Joseph J Hail
*Assistant Examiner* — Shantese L McDonald
(74) *Attorney, Agent, or Firm* — Wright IP & International Law; Eric G. Wright

(57) ABSTRACT

A combination handle clamp, beverage bottle and can opener having a generally curved shaped body and integral attachment point to allow connection to other personal item such as a key ring. A secondary and tertiary integral curved section form a pair of loading points for fixing open a handle-trigger assembly and incorporate a gripping edge to facilitate opening a crimped or vacuum sealed bottle top. The tertiary curved section additionally functions as a second clamp position for the larger handles and also doubles as a pry mechanism to assist opening a pop-top can. The said gripping edge of the invention which contacts with said bottle top to be constructed of a durable material that won't abrade from its intended use.

17 Claims, 2 Drawing Sheets

Fig. 3a
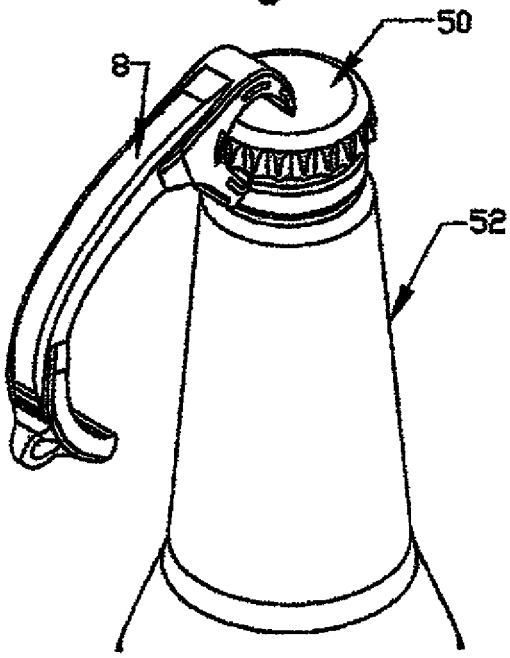
Fig. 4
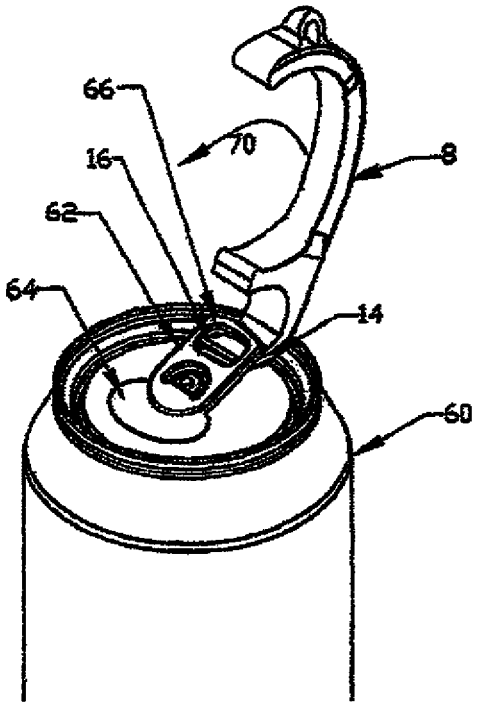
Fig. 3b
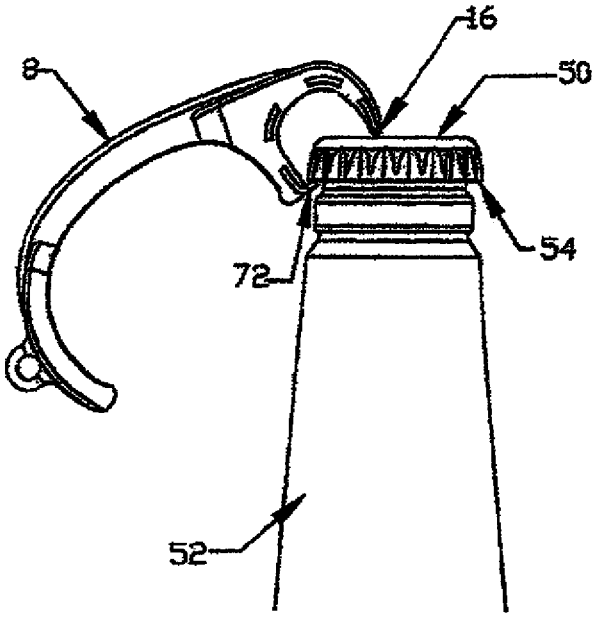
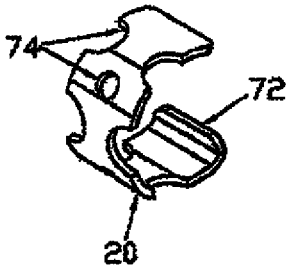
Fig 5

BEVERAGE CONTAINER OPENER

CROSS REFERENCE TO RELATED APPLICATIONS

This patent application is a continuation of and claims the benefit of the filing date of copending U.S. patent application Ser. No. 12/798,627 entitled "Combination Handle Locking And Beverage Container Opener" filed on Apr. 8, 2010.

INCORPORATION BY REFERENCE

This patent application incorporates by reference in its entirety copending U.S. patent application Ser. No. 12/798,627 entitled "Combination Handle Locking And Beverage Container Opener" filed on Apr. 8, 2010.

FEDERALLY SPONSORED RESEARCH OR DEVELOPMENT

Not Applicable

REFERENCE TO SEQUENCE LISTING

Not applicable

BACKGROUND OF THE INVENTION

This invention is designed to fix a typical handle-trigger assembly, such as a pressure washer, in the open position among other uses as described later. A frequent activity many drivers endure is washing their vehicles at self-service car washes which requires holding the handle-trigger portion in the open position while directing the high pressure water for extended periods of time. Most anyone who has performed this duty commonly experiences intense hand pain and cramping from depressing the trigger for extended periods. While this can be minimized by switching hands and taking breaks, the purchased operating time continues to count down. Since the current invention would be commonly kept in a vehicle, the incorporation of container opening is a logical and preferred. When traveling in an automobile it is common practice to purchase beverages and not have a typical opener readily available. Women with long forger nails or people with weak hands can easily open pop-top type beverage cans with the current invention. Likewise beverages contained in bottles that have crimped on caps can easily be removed with the current invention. Previously invented devices facilitate opening same containers but do not resolve the hand strain problems as described earlier. In order for the prior art to have the same opening capabilities and remain similarly compact in size required the use of hard to form plastics and secondary operations to install a gripping edge. Further, such devices had grooves that would jam up with small items such as coins or jewelry making them a nuisance to retrieve.

PRIOR ART

U.S. Pat. No. 4,949,600 makes reference to U.S. Pat. Nos. 1,199,272 and 4,583,429. U.S. Pat. No. 4,949,600 is a continuation of U.S. Pat. No. 4,864,898. The most relevant of these prior arts is U.S. Pat. No. 4,949,600 which describes a bottle and can opener comprised of glass reinforced nylon plastic that has a metal gripping attached in a secondary operation.

BRIEF SUMMARY OF THE INVENTION

The object of this invention is to provide an economical device, which assists opening common beverage containers and locks open many hand operated devices. The current invention shall be compact, safe, durable, comprised of standard materials, and easy to manufacture. The body of the current invention has a generally curved shape with three arcuate sections to provide elastic clamping resistance. The spacing between the three arcuate sections allows fixing open handle trigger assemblies of different sizes. Inserted into the shape of the middle arcuate section is a hardened edge to facilitate opening crimped type bottle caps and other pry-open type lids. On the one end of the outer arcuate section is a point which is oriented to provide significant mechanical advantage enabling the opening of pop-top type cans. The device of the current invention eliminates issues identified in the last section and offers more utility while being easy to manufacture from a variety of materials.

BRIEF DESCRIPTION OF THE SEVERAL VIEWS OF THE DRAWINGS

FIG. 3*a* is a first isometric view of the current invention engaged in opening a typical crimped on bottle cap.

FIG. 3*b* is a second isometric view of the current invention engaged in opening a typical crimped on bottle cap.

FIG. 4 is an isometric view of the current invention engaged in opening a typical pop-top can.

FIG. 5 is an isometric view of a clip that is inserted in the plastic version of the current invention.

DETAILED DESCRIPTION OF THE INVENTION

The combination handle locking bottle and can opener of the current invention facilitates the locking open of a hand operated device such as a pressure washer handle. Additionally, it encompasses in its shape clip 20 (also referred to herein as "insert 20" and "clip 20) which is an integral piece of steel or similar durable material that facilitates the opening of a bottle cap and the opening of a pop-top can.

The current invention is generally formed by combination of two pieces a metallic clip or insert 20 and a body 10. This invention also acknowledges and includes the formation of this device as an extruded or cast material enabling it to be manufactured from a single material such as aluminum.

When this device is formed with plastic it can be readily injection molded in an insert type molder. Since it incorporates a clip 20 a variety of types of plastic can be utilized. This is different from some prior art requiring the use of more costly glass reinforced plastic and a secondary operation. In addition, nylon type plastic and especially reinforced plastics require more expensive tooling and higher temperatures which uses more energy to manufacture.

Figure 1:
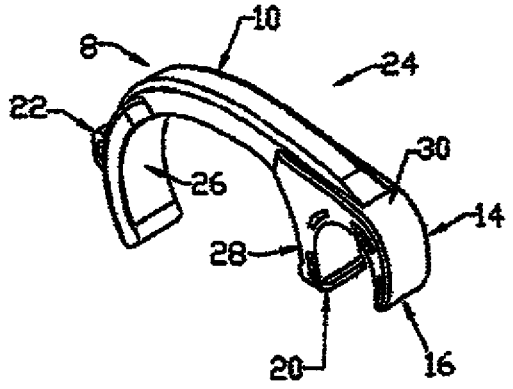
FIG. 1 is an isometric view of the current invention, a handle locking bottle and can opener.

In FIG. 1 an isometric drawing of the current invention which shows its components. The body 10 of the current invention 8 has a handle portion 24 and an eye 22 enabling attachment of the current invention 8 to a key ring or key chain. The body 10 of the current invention 8 included a section 14, which incorporates a tapered edge 16 (also referred to herein as "tapered edge 16" and "bottle cap engaging edge 16"). As such the tapered edge is capable of being slid underneath and through a lift tab of a pop top can. The tapered edge 16 serves additionally as a pivot point when the grip edge 72 is engaged under a bottle cap or a vacuum-sealed lid edge. The body 10 of the current invention 8 extends in an arc shaped section 26 and arc shaped section 28 to form a semi rigid structure that is sized to fit around the handle and activation lever of many devices such as a pressure washers.

Figure 2A:
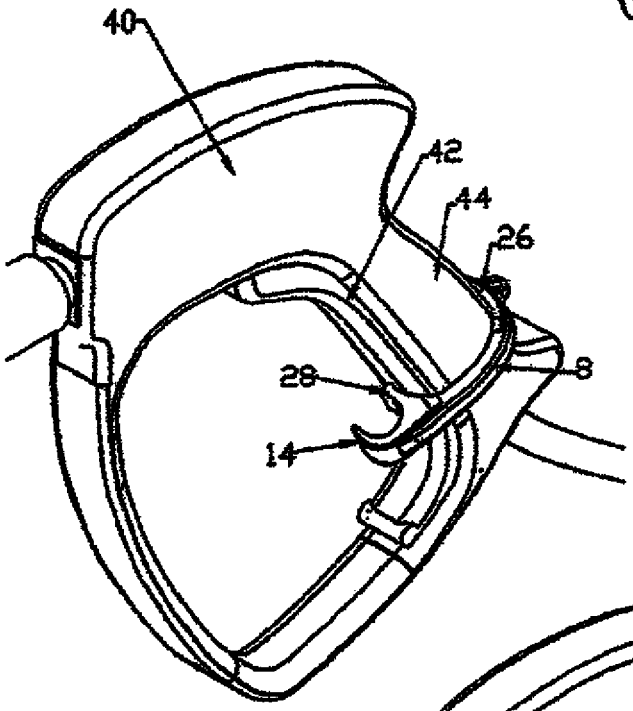
FIG. 2*a* is first isometric view of the current invention engaged in holding open the trigger of a pressure washer or other hand-activated device.
Figure 2B:
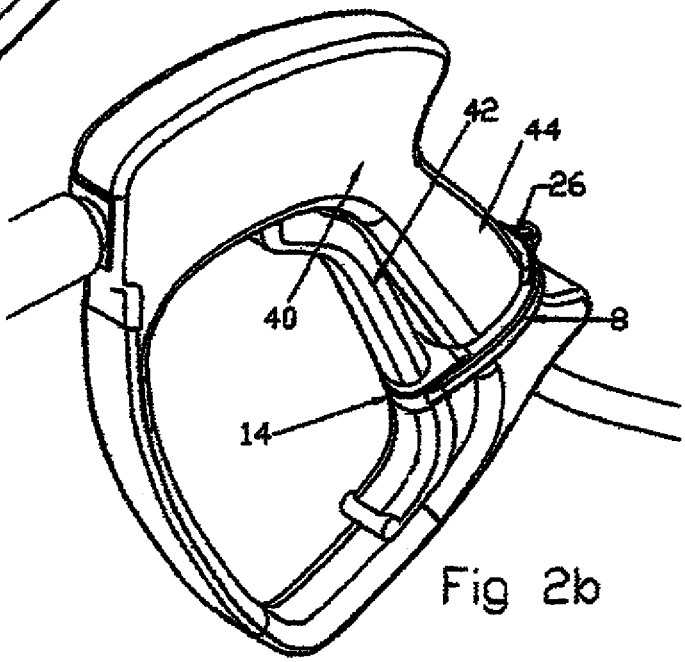
FIG. 2*b* is an second isometric view of the current invention engaged in holding open the trigger of a pressure washer or other hand-activated device.

In FIG. 2 the current invention 8 of the invention is being utilized to lock open the trigger 42 of pressure washer 40. The arc sections 26 and 28 resist the return of trigger 42 by applying opposite compressing forces. In the event the user finds the current invention 8 too small to fit around handle 44 and trigger 42 a secondary position of trigger 42 is available from the formation of the current invention arc section 14 as illustrated by FIG. 2*b*.

In FIG. 3 the current invention 8 is shown removing the cap 50 from a bottle 52. This is done by placing gripping edge 72 under cap edge 54 and the tip 16 as the fulcrum point placed on top of cap 50. Natural rotation of the current invention 8 easily removes the cap 50 from bottle 52. Design of the current invention further assists the user by providing natural positioning of pointer and middle fingers under the current invention 8 handle portion 24 and thumb of same hand on back of arc section 30.

In FIG. 4 illustrates the current invention 8 engaged in opening the pop-top 64 of a typical beverage can 60. The current invention is slid under tab 62 and slid up into tab hole 66. The current invention 8 is then tilted in arc 70 direction to displace tab 64 into can.

In FIG. 5 clip 20 is the insert placed in the current invention 8 forming the bottle cap engaging edge 16 for the current invention that would be formed of plastic material. The clip 20 has deformations 74 to adhere and provide load transfer. Clip 20 enables the plastic to be of many type as the clip provides reinforcement to the current invention 8. Clip 20 further provides gripping edge 72 that is durable against bottle caps. Clip 20 provides improvement over prior art obviating the need for reinforced high tensile strength plastics, hardened injection mold tooling and secondary assembly operation in prior arts.

I claim:

1. A body, comprising:

a bottle cap opening section having a first bottle cap engaging portion having a reinforcing member, a first curved portion and a first edge portion adapted to contact a first portion of a bottle cap, said reinforcing member having a first reinforcing member portion and a second reinforcing member portion;

said first bottle cap engaging portion having said first curved portion having a first plastic portion reinforced by said first reinforcing member portion embedded at least in part in said first plastic portion; and a second bottle cap engaging portion having a second curved portion and a second edge portion adapted to contact a second portion of said bottle cap, said second bottle cap engaging portion having said second curved portion having a second plastic portion reinforced by said second reinforcing member portion embedded at least in part in said second plastic portion, wherein said first edge portion and said second edge portion are separated by a distance which allows reversible engagement of said bottle cap by said first bottle cap engaging portion and said second bottle cap engaging portion, wherein said first reinforcing member portion reinforces said first curved portion and said second reinforcing member portion reinforces said second curved portion, and wherein said reinforcing member extends at least from said first curved portion to said second curved portion.

2. The body according to claim 1, in which said bottle cap opening section comprises a polymer and a reinforcing member comprising a reinforcing member material different than said polymer.

3. The body according to claim 2, in which said reinforcing member material is harder than said polymer.

4. The body according to claim 2, in which said reinforcing member material comprises a metal.

5. The body according to claim 1, in which said bottle cap opening section comprises a plastic which is in contact with a reinforcing member which comprises a clip portion.

6. The body according to claim 1, in which said bottle cap opening section comprises a reinforcing member which comprises a clip portion which comprises a notch or deformation.

7. The body according to claim 1, in which said bottle cap opening section comprises a reinforcing member which comprises a clip portion which comprises an opening.

8. The body according to claim 1, in which said bottle cap opening section comprises a reinforcing member which comprises a clip portion which comprises a gripping edge.

9. The body according to claim 1, in which said bottle cap opening section is adapted to open a pop-top can.

10. The body according to claim 1, in which said bottle cap opening section comprises tapered edge adapted to reversibly engage a lift tab of a pop-top can.

11. The body according to claim 1, in which said bottle cap opening section is adapted to open a pry-open lid.

12. The body according to claim 1, in which said bottle cap opening section further comprises a grip edge adapted to reversibly engage a bottle cap.

13. The body according to claim 1, in which said bottle cap opening section further comprises a grip edge adapted to reversibly engage a bottle cap, said bottle cap opening section further comprising a tip, said bottle cap opening section configured such that when said grip edge is reversibly engaged to a bottle cap a portion of said tip is configured to contact a portion of a top of said bottle cap.

14. The body according to claim 1, further comprising an eye.

15. The body according to claim 1, in which said bottle cap opening section further comprises a portion which is configured to reversibly engage a bottle cap and which is configured to reversibly engage a lift tab of a pop-top can.

16. An opening device, comprising:

a body;

a reinforcing member having a reinforcing member having a first reinforcing member portion and a second reinforcing member portion;

said body having a bottle cap opening section having said first reinforcing member portion having an arcuate shape and reinforcing a first plastic portion which has an arcuate shape and configured to accommodate reversible engagement with a bottle cap by the bottle cap opening section, and said second reinforcing member portion reinforcing a second plastic portion and configured to accommodate reversible engagement with a bottle cap by the bottle cap opening section, and wherein said first reinforcing member portion has a metal portion embedded at least in part in said first plastic portion, wherein said second reinforcing member portion has a metal portion embedded at least in part in said second plastic portion, wherein said reinforcing member extends at least in part from said first plastic portion to said second plastic portion, wherein said bottle cap opening section is free of a reinforced high tensile strength plastic.

17. A body, comprising:

a reinforcing member having a first reinforcing portion and a second reinforcing portion, said reinforcing member having a first reinforcing member portion that extends into a bottle cap opening section and a second reinforcing member portion that extends into a second bottle cap engaging portion;

a bottle cap opening section having a first bottle cap engaging portion having a first curved portion and a first edge portion adapted to contact a first portion of a bottle cap, said first bottle cap engaging portion having said first curved portion having a first plastic portion reinforced by a first reinforcing member portion embedded at least in part in said first plastic portion;

a second bottle cap engaging portion having a second curved portion and a second edge portion adapted to contact a second portion of said bottle cap, said second bottle cap engaging portion having said second curved portion having a second plastic portion reinforced by a second reinforcing member portion embedded at least in part in said second plastic portion;

wherein said first edge portion and said second edge portion are separated by a distance which allows reversible engagement of said bottle cap by said first bottle cap engaging portion and said second bottle cap engaging portion, and wherein said first reinforcing member portion reinforces said first curved portion, wherein said second reinforcing member portion reinforces said second curved portion; and wherein said reinforcing member extends at least from said first curve portion to said second curved portion.

* * * * *